US008462090B2

(12) United States Patent
Liu et al.

(10) Patent No.: US 8,462,090 B2
(45) Date of Patent: Jun. 11, 2013

(54) DISPLAY DEVICE AND ELECTRONIC SYSTEM UTILIZING THE SAME

(75) Inventors: Ping-Lin Liu, Tainan (TW); Du-Zen Peng, Jhubei (TW)

(73) Assignee: Chimei Innolux Corporation, Chu-Nan (TW)

( * ) Notice: Subject to any disclaimer, the term of this patent is extended or adjusted under 35 U.S.C. 154(b) by 0 days.

(21) Appl. No.: 13/437,883

(22) Filed: Apr. 2, 2012

(65) Prior Publication Data

US 2012/0188222 A1 Jul. 26, 2012

Related U.S. Application Data

(63) Continuation of application No. 12/157,704, filed on Jun. 11, 2008, now Pat. No. 8,199,082.

(30) Foreign Application Priority Data

Aug. 31, 2007 (TW) ..... 96132437 A

(51) Int. Cl.
*G09G 3/32* (2006.01)

(52) U.S. Cl.
USPC ..... 345/82

(58) Field of Classification Search
USPC ..... 345/76, 77, 204, 82; 315/169.1, 315/312
See application file for complete search history.

(56) References Cited

U.S. PATENT DOCUMENTS

| | | | | |
|---|---|---|---|---|
| 7,112,927 | B2 * | 9/2006 | Osame et al. | 315/169.1 |
| 7,224,333 | B2 | 5/2007 | Yamazaki et al. | |
| 7,348,738 | B2 * | 3/2008 | Foust et al. | 315/312 |
| 7,652,647 | B2 * | 1/2010 | Kageyama et al. | 345/82 |
| 7,663,615 | B2 * | 2/2010 | Shirasaki et al. | 345/204 |
| 7,750,875 | B2 * | 7/2010 | Kim et al. | 345/82 |
| 2006/0232524 | A1 | 10/2006 | Cok | |
| 2008/0048947 | A1 | 2/2008 | Liu | |

* cited by examiner

*Primary Examiner* — Chanh Nguyen
*Assistant Examiner* — James Nokham
(74) *Attorney, Agent, or Firm* — Liu & Liu

(57) ABSTRACT

A display device including a pixel unit, a selection unit, and a control unit is disclosed. The pixel unit includes a driving transistor and a capacitor. The driving transistor includes a gate and a source. The capacitor is coupled between the gate and the source. The selection unit selectively transmits a first voltage or a second voltage to the driving transistor. The control unit controls the selection unit and receives the voltage of the source.

10 Claims, 4 Drawing Sheets

DISPLAY DEVICE AND ELECTRONIC SYSTEM UTILIZING THE SAME

CROSS REFERENCE TO RELATED APPLICATIONS

This Application is a Continuation of U.S. patent application Ser. No. 12/157,704 filed on Jun. 11, 2008, which claims priority to Taiwan Patent Application No. 096132437, filed on Aug. 31, 2007, the entirety of which is incorporated by reference herein.

BACKGROUND OF THE INVENTION

1. Field of the Invention

The invention relates to a display device, and more particularly to a display device for obtaining the threshold voltage of a transistor.

2. Description of the Related Art

Because cathode ray tubes (CRTs) are inexpensive and provide high definition, they are utilized extensively in televisions and computers. With technological development, new flat-panel displays are continually being developed. When a larger display panel is required, the weight of the flat-panel display does not substantially change when compared to CRT displays. Generally, flat-panel displays comprises liquid crystal displays (LCD), plasma display panels (PDP), field emission displays (FED), and electroluminescent (EL) displays.

Electroluminescence (EL) display devices include organic light emitting diode (OLED) displays and polymeric light emitting diode (PLED) displays. In accordance with associated driving methods, an OLED can be an active matrix type or a positive matrix type. An active matrix OLED (AM-OLED) display typically is thin and exhibits lightweight characteristics, spontaneous luminescence with high luminance efficiency and low driving voltage. Additionally, an AM-OLED display provides the perceived advantages of increased viewing angle, high contrast, high-response speed, full color and flexibility.

An AM-OLED display is driven by electric current. Specifically, each of the pixel units of an AM-OLED display includes a driving transistor and an OLED. The driving transistor provides a driving current such that the OLED can be lit. The brightness of the OLED is determined by the driving current. Due to manufacturing procedures, different driving transistors comprise different threshold voltages. Thus, conventional OLEDs generate abnormal brightness.

BRIEF SUMMARY OF THE INVENTION

Display devices are provided. An exemplary embodiment of a display device comprises a pixel unit, a selection unit, and a control unit. The pixel unit comprises a driving transistor and a capacitor. The driving transistor comprises a gate and a source. The capacitor is coupled between the gate and the source. The selection unit selectively transmits a first voltage or a second voltage to the driving transistor. The control unit controls the selection unit and receives the voltage of the source.

Electronic systems are also provided. An exemplary embodiment of an electronic system comprises a display device and a transformation device. The display device displays an image according to a power signal. The transformation device transforms an external power into the power signal. The display device comprises a pixel unit, a selection unit, and a control unit. The pixel unit comprises a driving transistor and a capacitor. The driving transistor comprises a gate and a source. The capacitor is coupled between the gate and the source. The selection unit selectively transmits a first voltage or a second voltage to the driving transistor. The control unit controls the selection unit and receives the voltage of the source.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
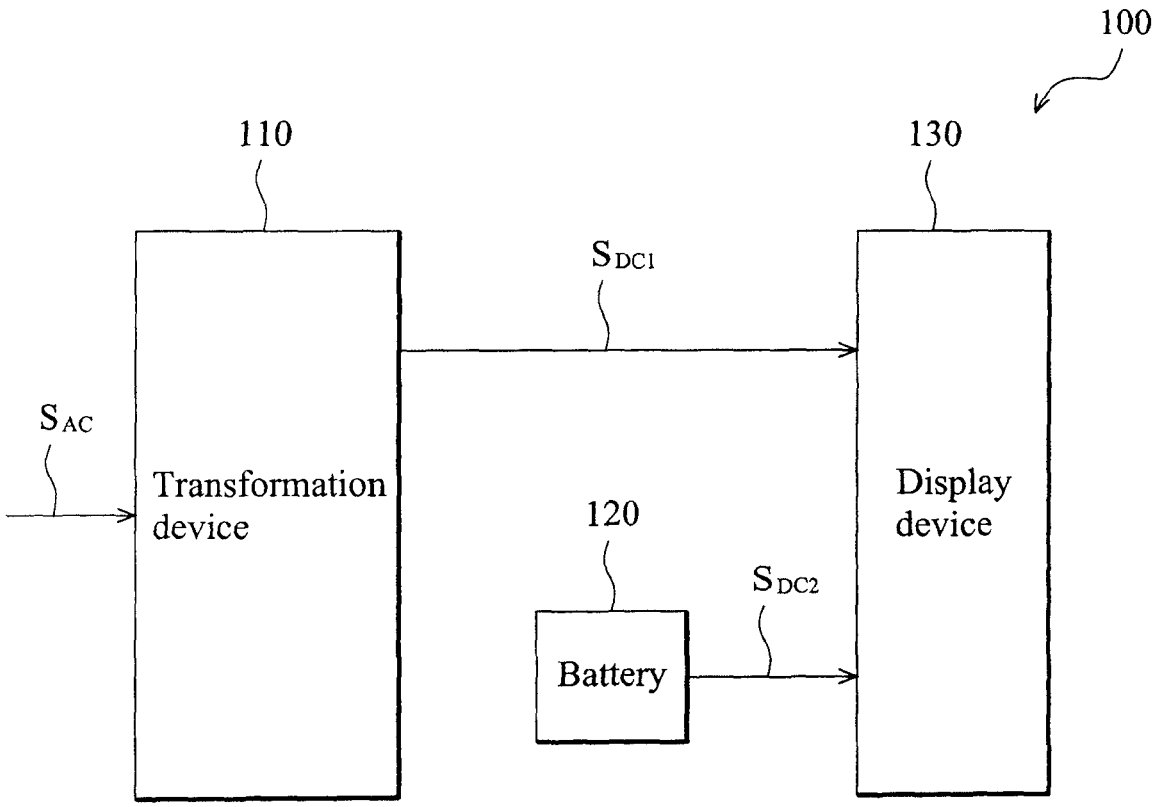
FIG. 1 is a schematic diagram of an exemplary embodiment of an electronic system.

FIG. 1 is a schematic diagram of an exemplary embodiment of an electronic system. In this embodiment, the electronic system 100 could be a personal digital assistant (PDA), a cellular phone, a digital camera (DSC), a television, a global positioning system (GPS), a car display, an avionics display, a digital photo frame, a notebook computer (NB), or a personal computer (PC). As shown in FIG. 1, the electronic system 100 comprises a transformation device 110, a battery 120, and a display device 130. The transformation device 110 transforms an external power $S_{AC}$ into a power signal $S_{DC1}$, wherein the external power $S_{AC}$ may be an alternating current (AC) signal and the power signal $S_{DC1}$ may be a direct current (DC) signal. The battery 120 provides a power signal $S_{DC2}$. The display device 130 displays an image according to the power signal $S_{DC1}$ or $S_{DC2}$.

In one embodiment, when the transformation device 110 does not receive the external power $S_{AC}$, the display device 130 displays an image according to the power signal $S_{DC2}$. When the transformation device 110 receives the external power $S_{AC}$, the display device 130 displays an image according to the power signal $S_{DC1}$.

Figure 2:
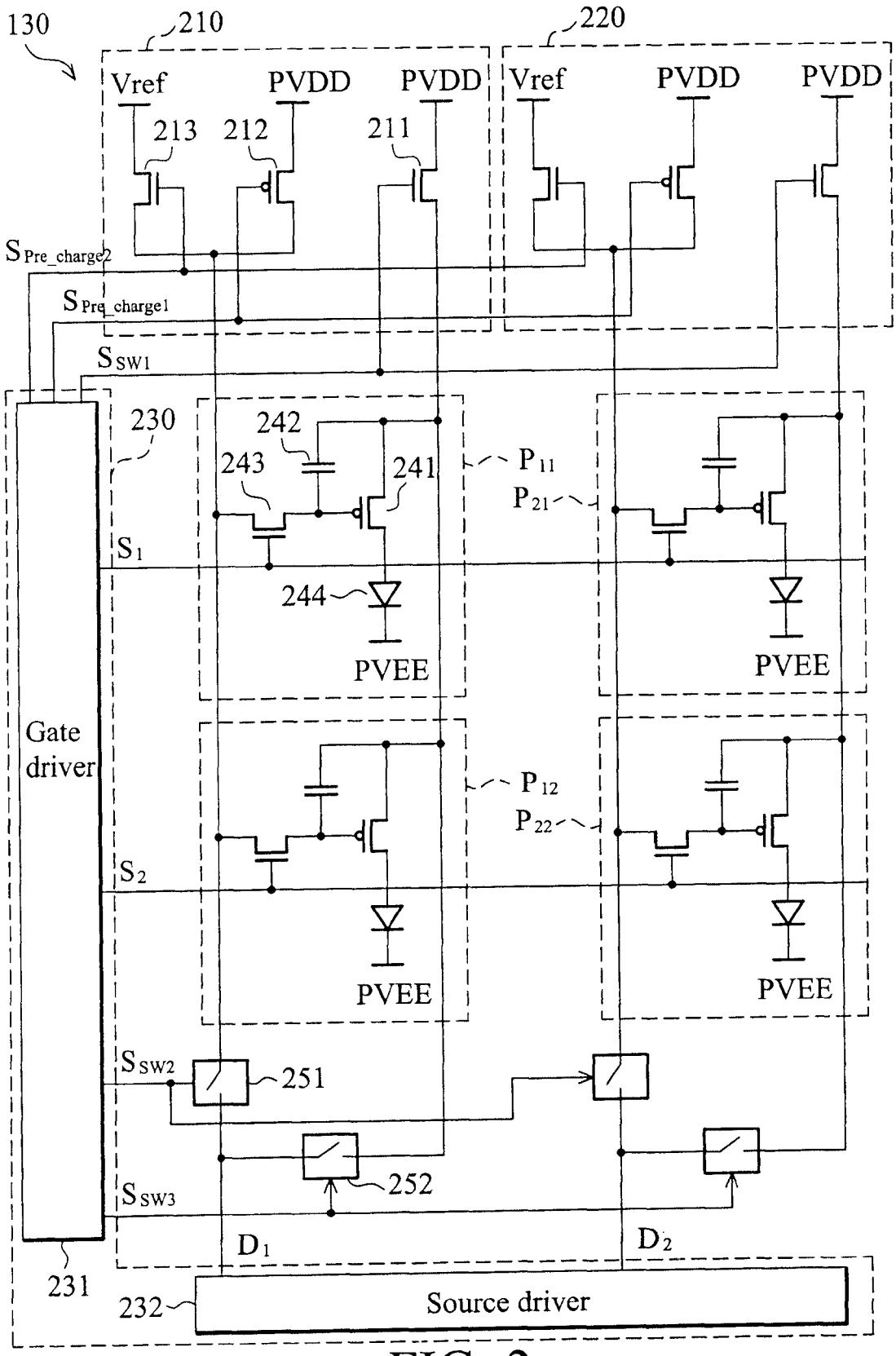
FIG. 2 is a schematic diagram of an exemplary embodiment of the display device.

FIG. 2 is a schematic diagram of an exemplary embodiment of the display device. The display device 130 comprises pixel units $P_{11}$~$P_{22}$, a selection units 210, 220, and a control unit 230. Generally, the display device 130 comprises various pixel units. For clarity, only four pixel units are shown in FIG. 2, but the disclosure is not limited thereto. Since the operations of pixel units $P_{11}$~$P_{22}$ are the same, the pixel unit $P_{11}$ is provided as an example.

The pixel unit $P_{11}$ comprises a driving transistor 241 and a capacitor 242. The capacitor 242 is coupled between the gate and the source of the driving transistor 241. In this embodiment, the pixel unit $P_{11}$ further comprises a switching transistor 243 and a lighting element 244. The switching transistor 243 transmits a signal to the gate of the driving transistor 241 according to a scan signal provided by a scan line $S_1$, wherein the signal is originated from a data line $D_1$. The lighting element 244 is lit according to a data signal originated from the data line $D_1$. In this embodiment, the lighting element 244 is an organic light emitting diode (OLED).

The selection units 210 and 220 selectively transmit voltage Vref or voltage PVDD to the driving transistors of the corresponding pixel units $P_{11}$~$P_{22}$. Since each of selection units is used to control the pixel units of the same data line, the amount of selection units is determined by the amount of data lines. To simplify the description, two selection units are shown in FIG. 2, but the disclosure is not limited thereto. As shown in FIG. 2, the selection unit 210 controls the pixel units $P_{11}$ and $P_{12}$ coupled to the data line $D_1$ for transmitting the voltage Vref or PVDD to the driving transistors of the pixel units $P_{11}$ and $P_{12}$. Similarly, the selection unit 220 controls the pixel units $P_{21}$ and $P_{22}$ coupled to a data line $D_2$ for transmitting the voltage Vref or PVDD to the driving transistors of the pixel units $P_{21}$ and $P_{22}$.

The control unit 230 controls the selection units 210 and 220 and receives the source voltages of the driving transistors of the pixel units $P_{11}$~$P_{22}$. In this embodiment, the control unit 230 comprises a gate driver 231 and a source driver 232. In addition to transmitting scan signals provided by the scan lines $S_1$ and $S_2$ to the pixel units $P_{11}$~$P_{22}$, the gate driver 231 also provides switching signals $S_{SW1}$~$S_{SW3}$ and pre-charge signals $S_{Pre\text{-}charge1}$ and $S_{Pre\text{-}charge2}$. Similarly, in addition to transmitting data signals provided by the data lines $D_1$ and $D_2$ to the pixel units $P_{11}$~$P_{22}$, the source driver 232 also receives the source voltages of the driving transistors of the pixel units $P_{11}$~$P_{22}$. The source driver 232 further provides data signals according to the source voltages of the driving transistors of the pixel units $P_{11}$~$P_{22}$.

Since the operations of the selection units 210 and 220 are the same, the selection unit 210 is provided as an example. During a first period, the selection unit 210 transmits the voltage PVDD to the gate and the source of the driving transistor 241 of the pixel unit $P_{11}$. During a second period, the selection unit 210 transmits the voltage Vref to the gate of the driving transistor 241. At this time, the source of the driving transistor 241 is discharged according to the threshold voltage of the driving transistor 241. The source driver 232 obtains the threshold voltage of the driving transistor 241 according to the source voltage of the driving transistor 241 and the voltage Vref.

For example, assuming the threshold voltage of the driving transistor 241 is 1V and the voltage Vref and PVDD are 2V and 5V, respectively, during the first period, the gate voltage and the source of the driving transistor 241 are 5V. Meanwhile, during the second period, the gate voltage of the driving transistor 241 is 2V. Since the threshold voltage of the driving transistor 241 is 1V, the source of the driving transistor 241 is discharged such that the source voltage of the driving transistor 241 is 3V. Thus, the source driver 232 utilizes the source voltage of the driving transistor 241 and the voltage Vref to obtain that the threshold voltage of the driving transistor 241 is 1V.

The source driver 232 obtains the threshold voltage of all driving transistors according to the above method. When the source driver 232 utilizes the threshold voltage of the driving transistor to adjust the data signal transmitted to the pixel units, a phenomenon can be compensated. The phenomenon is caused because the different driving transistors may comprise different threshold voltages.

In this embodiment, a switch 252 is coupled between the data line $D_1$ and the source of the driving transistor 241 and selectively electrically connects the data line $D_1$ and the source of the driving transistor 241 according to the switching signal $S_{SW3}$. When the switch 252 is turned on or not, the source driver 232 can receive the source voltage of the driving transistor 241. In this embodiment, the switch 252 is turned on during the second period. Additionally, a switch 251 is coupled between the data line $D_1$ and the drain of the switching transistor 243 for transmitting the data signal to the pixel units. In this embodiment, the switch 251 selectively electrically connects the data line $D_1$ and the switching transistor 243.

In this embodiment, the selection unit 210 comprises transistors 211~213 for selectively providing the voltage Vref or PVDD to the pixel units. As shown in FIG. 2, the transistors 211 and 213 are N-type transistors and the transistor 212 is a P-type transistor, but the disclosure is not limited thereto. The transistor 211 transmits the voltage PVDD to the source of the driving transistor 241 according to the switching signal $S_{SW1}$. The transistor 212 transmits the voltage PVDD to the gate of the driving transistor 241 according to the pre-charge signal $S_{Pre\text{-}charge1}$. The transistor 213 transmits the voltage Vref to the gate of the driving transistor 241 according to the pre-charge signal $S_{Pre\text{-}charge2}$.

Figure 3:
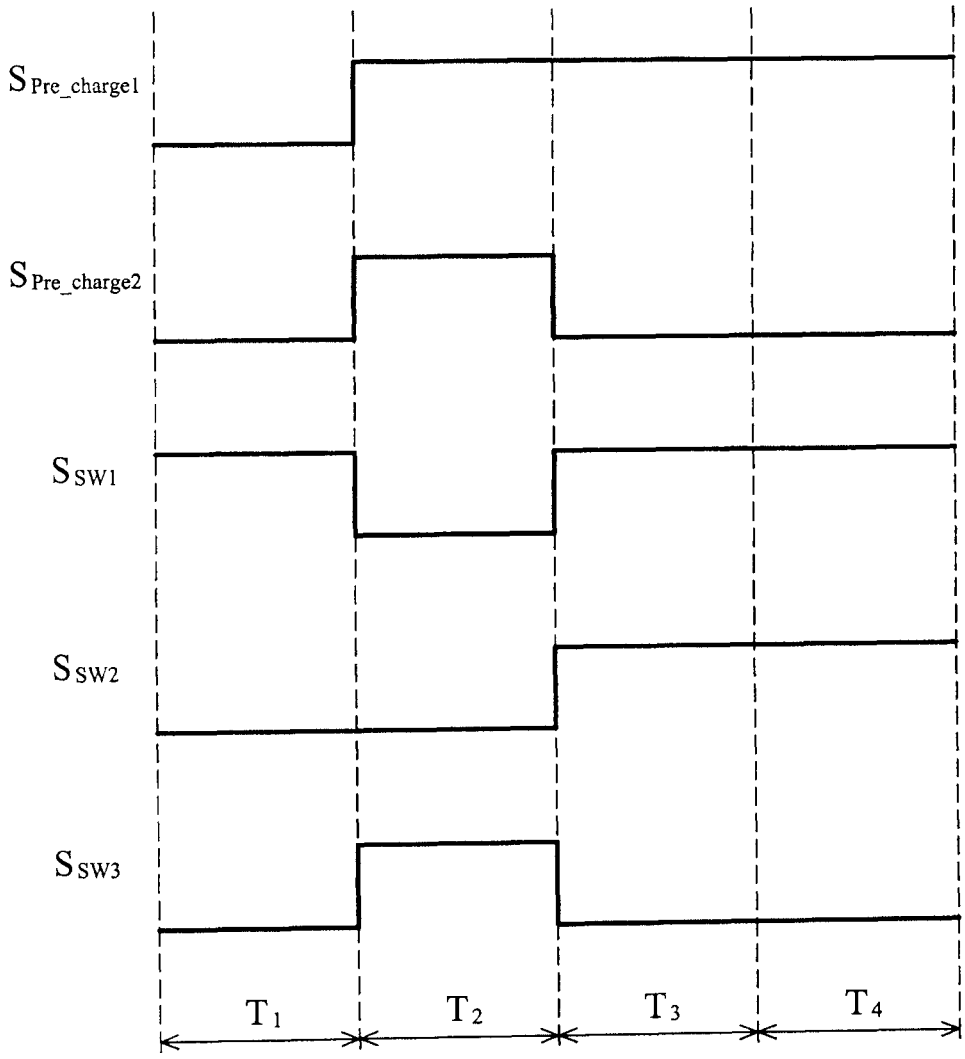
FIG. 3 is a timing chart.

FIG. 3 is a timing chart. Referring to FIG. 2, the pre-charge signal $S_{Pre\text{-}charge1}$ is at a low level and the switching transistor 243 is turned on during the first period $T_1$. Thus, the gate of the driving transistor 241 receives the voltage PVDD. Since the switching signal $S_{SW1}$ is at a high level, the transistor 211 is turned on such that the source of the driving transistor 241 receives the voltage PVDD. At this time, the pre-charge signal $S_{Pre\text{-}charge2}$, the switching signals $S_{SW2}$, and $S_{SW3}$ are at low levels such that the transistor 213, switches 251 and 252 are turned off.

During the second period $T_2$, the pre-charge signal $S_{Pre\text{-}charge1}$ is at the high level and the switching signal $S_{SW1}$ is at the low level such that the transistors 212 and 211 are turned off. Since the pre-charge signal $S_{Pre\text{-}charge2}$ is at the high level, the transistor 213 is turned on. When the switching transistor 243 is turned on, the gate of the driving transistor 241 can receive the voltage Vref. Since the switching signal $S_{SW2}$ is at the low level and the switching signal $S_{SW3}$ is at the high level, the switch 251 is still turned off and the switch 252 is turned on. Thus, the source driver 232 can receive the source voltage of the driving transistor 241.

The source driver 232 utilizes the threshold voltages of the driving transistors of the pixel units for actively adjusting the data signal transmitted to each pixel unit. Thus, the phenomenon can be compensated. The phenomenon is caused because the different driving transistors may comprise different threshold voltages.

During the third period $T_3$, the pre-charge signal $S_{Pre\text{-}charge1}$ is at the high level and the pre-charge signal $S_{Pre\text{-}charge2}$ is at the low level such that the transistors 212 and 213 are turned off. Since the switching signals $S_{SW1}$ and $S_{SW2}$ are at the high level and the switching signal $S_{SW3}$ is at the low level, the switches 211 and 251 are turned on and the switch 252 is turned off.

The source driver 232 adjusts the data signal transmitted to the pixel unit $P_{11}$ according to the threshold voltage of the driving transistor 241 during the second period $T_2$. Thus, the pixel unit $P_{11}$ displays the corresponding brightness according to the adjusted data signal during the third period $T_3$ and the fourth period $T_4$.

Figure 4:
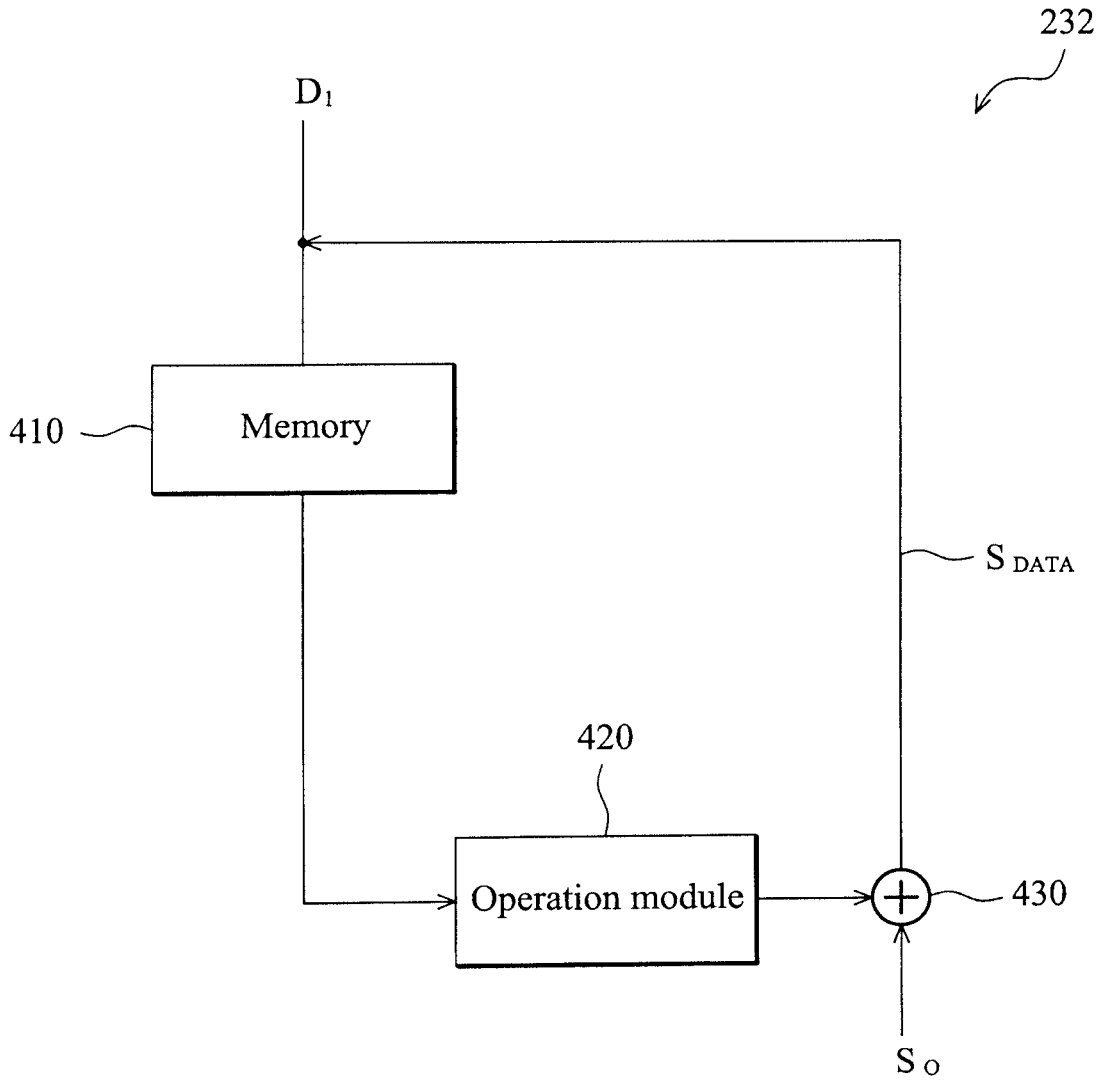
FIG. 4 is a schematic diagram of an exemplary embodiment of the source driver.

FIG. 4 is a schematic diagram of an exemplary embodiment of the source driver. The source driver 232 comprises a memory 410, an operation module 420, and an adder 430. Referring to FIG. 2, when the switch 252 is turned on, the memory 410 can store the source voltage of the driving transistor 241. The operation module 420 obtains the threshold voltage of the driving transistor 241 according to the source voltage of the driving transistor 241 and the voltage Vref. The adder 430 originates the data signal $S_{DATA}$ according to an original signal $S_O$ and the threshold voltage of the driving transistor 241 and provides the data signal $S_{DATA}$ to the data line $D_1$ during the third period $T_3$. Since the switch 251 is turned on during the third period $T_3$, the pixel unit $P_{11}$ can utilize the data line $D_1$ to receive the data signal $S_{DATA}$.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device, comprising:

a pixel unit comprising:

a driving transistor comprising a gate and a source; and a capacitor coupled between the gate and the source;

a selection unit selectively transmitting a first voltage or a second voltage to the driving transistor, wherein the selection unit transmits the first voltage to the gate and the source during a first period and transmits the second voltage to the gate during a second period; and a control unit controlling the selection unit and receiving the voltage of the source, wherein the control unit comprises a source driver receiving the voltage of the source during the second period, wherein the source driver originates a data signal according to the voltage of the source during the second period, wherein the voltage of the source and the voltage of the gate are equal to the first voltage during the first period, and wherein the first and the second periods are successive.

2. The display device as claimed in claim 1, wherein the control unit detects the voltage of the source during the second period.

3. The display device as claimed in claim 1, wherein the pixel unit comprises:

a switching transistor transmitting one of the first and the second voltage to the gate, wherein the switching transistor transmits the first voltage during the first period and transmits the second voltage during the second period.

4. The display device as claimed in claim 3, wherein the driving transistor is a P-type transistor and the switching transistor is an N-type transistor.

5. The display device as claimed in claim 3, wherein one terminal of the switching transistor is directly connected to the gate of the driving transistor.

6. An electronic system, comprising:

a display device as in claim 1, displaying an image according to a power signal.

7. The electronic system as claimed in claim 6, wherein the control unit receives the voltage of the source during the second period.

8. The electronic system as claimed in claim 7, wherein the external power is an alternating current signal and the power signal is a direct current signal.

9. The electronic system as claimed in claim 6, further comprising a battery providing the power signal.

10. The electronic system as claimed in claim 6, wherein the electronic system is a personal digital assistant, a cellular phone, a digital camera, a television, a global positioning system, a car display, an avionics display, a digital photo frame, a notebook computer, or a personal computer.

* * * * *